United States Patent [19]

Eisenmann et al.

[11] Patent Number: 4,718,603

[45] Date of Patent: Jan. 12, 1988

[54] ANCHOR FOR A RAILWAY TIE EMBEDDED IN BALLAST

[75] Inventors: Josef Eisenmann, Munich; Henning von Heimburg, Lüdenscheid; Friedhelm Weber, Neuenrade; Dirk Vorderbrück; Helmut Eisenberg, both of Werdohl, all of Fed. Rep. of Germany

[73] Assignee: Vossloh-Werke GmbH, Werdohl, Fed. Rep. of Germany

[21] Appl. No.: 913,958

[22] Filed: Oct. 1, 1986

Related U.S. Application Data

[63] Continuation of Ser. No. 702,346, Feb. 15, 1985, abandoned.

[30] Foreign Application Priority Data

Mar. 27, 1984 [DE] Fed. Rep. of Germany ..... 3411277

[51] Int. Cl.[4] ..... E01B 3/48

[52] U.S. Cl. ..... 238/106; 238/29

[58] Field of Search ..... 238/1, 29, 106

[56] References Cited

U.S. PATENT DOCUMENTS

| | | | |
|---|---|---|---|
| 924,415 | 6/1909 | Barton, Sr. | 238/106 |
| 1,295,859 | 5/1919 | Dambrowski | 238/106 |

FOREIGN PATENT DOCUMENTS

| | | | |
|---|---|---|---|
| 3107990 | 9/1982 | Fed. Rep. of Germany . | |
| 576713 | 5/1924 | France | 238/106 |
| 688260 | 8/1930 | France | 238/106 |

*Primary Examiner*—David A. Scherbel
*Assistant Examiner*—Glenn B. Foster
*Attorney, Agent, or Firm*—James J. Ralabate

[57] ABSTRACT

Anchor for a railway tie embedded in ballast. In order to further simplify the installation of such an anchor, the clamp is constructed in two or more parts. With an anchor construction having a clamp gripping the tie on both sides, the clamp parts are constructed of approximately the same size in order to form clamp halves, the connection is formed as a pivot arrangement and in the region of the connection position a tightening means is provided for producing a tightening force clamping the clamp halves on the tie.

5 Claims, 6 Drawing Figures

ANCHOR FOR A RAILWAY TIE EMBEDDED IN BALLAST

This is a continuation of application Ser. No. 702,346 filed Feb. 15, 1985, now abandoned.

The present invention relates to an anchor for a railway tie embedded in ballast comprising an approximately U-shaped clamp secured on the tie and embracing this substantially transversely of its tie axis in the region of the tie upper and lateral surfaces, on the ends of which clamp are secured respective plates each lying substantially in a vertical plane directed transversely and/or parallel to the tie axis and extending into the ballast for increasing the transverse and/or longitudinal resistance to displacement of the railway.

In contrast to so-called safety caps, anchors of the above-described type can be easily installed on the ballast bed without substantial track lifting work (cf. DE-PS 31 07 990). For this purpose it is only necessary to displace the U-shaped clamp with its open side on the tie approximately transversely of the tie axis with application of downward force in such manner that the plates are driven into the ballast bed respectively in front of and behind the tie, possibly under vibration.

Anchors of this type can be arranged at any desired position of the tie, i.e. even in the middle of the tie, so that the ballast bed which is anyway strongly loaded can be relieved in the region of the tie heads and possibly can be economized on broad ballast strips in front of the tie heads.

Reference should be made to the explanations in DE-PS 31 07 990 for further advantages.

With anchors of this type during installation the problem exists that the two plates, as a result of their relatively stiff connection through the clamp, must always be driven into the ballast bed together and simultaneously. Since the penetration behaviour of the two plates into the ballast bed is not however identical, differences must be immediately noticed and compensated, as a result of which precise operations are necessary during installation. With clamps formed as spring clamps, the clamp must moreover be held during the entire insertion process in a forced-open condition with a relatively large force and simultaneously the drive-in force must be applied perpendicularly to this. This requires a special spreading device whose spreading effect must not be lost even during impacts and the application of vibrations.

An object of the present invention is now to develop the anchor of the type described in the introduction in such manner that installation is further simplified in particular in respect to the above-described problems.

This object is solved according to the invention in that the clamp is constructed of two or more parts and the clamp parts are connected together in the installed condition.

As a result of the features according to the invention, an anchor is provided for the first time with which the plates need no longer be driven in together and simultaneous, i.e. synchronously into the ballast bed, but can be driven in independently from one another, i.e. sequentially or at least alternately one after the other into the ballast bed. As a result, the installation is considerably facilitated and simplified.

When the plates and the clamped parts are located at the predetermined position, they can be secured to the tie in any desired manner, for example by means of screws or the like.

In an anchor represented as preferred in DE-PS 31 07 990, having clamps formed from spring steel these grip slightly below both sides of the tie on the underside whereby in addition to the gripping connection a form locking connection of the clamp with the tie is created. In order now with such a construction to achieve the above-described advantages in respect of installation, according to an advantageous further development of the invention it is proposed to construct the clamp parts for formation of two clamp halves of approximately equal size, to equip the connection as a pivoting arrangement and to provide in the region of the connection position a tightening means for production of a gripping force to tighten the clamp halves on the tie.

By such an embodiment a completely new anchor concept is created. Thus, the plates can be driven into the ballast bed with a completely unstressed clamp either individually or together without the obstructing tightening device. It is of particular advantage that the tightening force is exerted on the clamp only after reaching of the final position of the plate in the ballast bed.

Fundamentally, the clamp halves can be formed in any desired manner. It is however advantageous to select a substantially L-shaped form which is arched in the region of the tie upper surface.

In order to ensure that the gripping force produced by the tightening means persists even over a long time period under load, it is advantageous if the clamp halves are manufactured of spring steel.

The pivot arrangement can be constructed basically in various ways. Thus, according to an advantageous further development, it is expedient to construct the pivoting arrangement as a hinge with a hinge axis running parallel to the tie axis.

It is particularly advantageous to embody the pivoting arrangement as a coupling arrangement with which the ends of the two clamp halves can be securely coupled together for limited mutual pivoting about an axis approximately parallel to the tie axis. In such an arrangement it is of great importance that the ends of the two clamp halves, after sequential insertion of the plates, can be simply and securely coupled together whilst permitting limited pivoting. Such a coupling arrangement can either be integrated in the ends of the two clamp halves or can include additional parts.

In a preferred exemplary embodiment the coupling arrangement has a separate coupling piece which has an upwardly open receiving channel which receives overlapping ends of the clamp halves. The coupling piece is in this connection equipped with a vertically directed sleeve which is secured, preferably welded, at its lower end in a bore of the coupling piece and extends with its free end through aligned elongate apertures in the mutually overlapping ends of the clamp halves.

In such a construction, the mutually overlapping ends of the clamp halves are laterally guided, the elongate holes ensuring the necessary mobility on the sleeve. In this manner, the ends of the clamp halves are on the one hand securely connected together and on the other hand it is ensured that the necessary pivoting is permitted at the connection position.

The tightening means can be constructed basically in any desired manner. However, wedge or screw arrangements are particularly simple and expedient tightening means. It is vital with such wedge or screw arrangements that they abut on the one hand on the upper side of the tie and on the other hand on the pivot arrangement of the anchor.

In the case of the above-described preferred exemplary embodiment having a coupling piece with an upwardly open receiving channel, it is advantageous if a screw bolt is selected as the tightening means which is arranged in an internal thread of the bore of the sleeve and abuts with its free lower end on a pressure plate on the upper side of the tie. Such an arrangement is technically simple, operationally reliable even after a long time and comparatively cheap.

Experiments have shown that with anchors of the type according to the invention as installation and removal can be carried out without changes in the ballast bed in a time not previously achieved. It is in this connection irrelevant on which position of the tie the anchor is to be installed or removed. The arrangement can be provided in a simple manner at practically any desired position of the tie. According to the latest time measurements, two persons require approximately ten minutes for installation of an anchor, whilst for removal of the anchor only two minutes are necessary. Preparatory or finishing work on the ballast bed are unnecessary both with installation and removal.

By an appropriate construction of the tightening means, the gripping force can be adjusted continuously (steplessly). Anchors of the type according to the invention are therefore suitable both for use with wood ties and also for use with concrete ties.

Anchors according to the invention are furthermore also reusable after long installation or storage time. It is in this connection only necessary to prevent corrosion by use of a suitable material or by use of a suitable surface protection.

In the case or re-laying and leveling work a tie anchor according to the invention need not be removed. It is only necessary to loosen the tightening means and after the work has been carried out to reestablish the necessary gripping force. These operations can easily be carried out when the tightening means is in the form of a screw arrangement with conventional screw machines without difficulties.

Since the ballast bed remains completely undamaged when installing anchors according to the invention, the desired increase of the transverse or longitudinal resistance to displacement is provided immediately after installation to the full extent.

As already described in DE-PS 31 07 990, the plates can be formed in various ways. A particularly advantageous effect is given however if the lower edge of each plate is constructed substantially straight and in each case makes an angle with the relevant side surface of the tie which is smaller than 90° and preferably lies in the range between 60° and 80°. When a plate constructed in this manner is driven in, this will always have the tendency as a result of the inclined lower edge to move in towards the tie whereby the contact with the tie is retained and thereby the gripping of the tie in the final position is ensured.

According to a further advantageous embodiment, also the upper edge of each plate is formed substantially straight and inclined in such manner that in each case it includes an angle with the relevant side surfaces of the tie which is smaller than 90° and preferably lies between 60° and 80°. Also by these measures it is achieved that the plate retains contact with the tie during the drive-in process since by means of the inclination of the upper edge when a drive-in tool is applied to the upper edge besides a component in the vertical direction also a component directed towards the tie lateral surfaces is present.

In a particularly expedient construction the upper edge of each plate consists of two substantially straight sections, the first section adjoining the respective clamp half making an angle of 60° to 80° with the relevant lateral surface of the tie and the adjoining second section including an angle between 30° and 40°. In the normal case it is sufficient if the drive-in tool is effective on the first section. Should however as a result of unfavorable positioning of the ballast in the ballast bed the clamp or the projection provided for this not sufficiently engage the tie, it is only necessary to shift the drive-in tool to the second section and to exert a further driving force on the plate. As a result of the relatively acute angle between 30° and 40° relative to the relevant lateral surfaces of the tie, the plate will immediately assume the predetermined position in such a case.

In the above-described exemplary embodiment in which the mutually overlapping ends of the clamp halves are in contact in a receiving channel of a coupling piece, it is advantageous if the end lying below in the receiving channel is straight and the overlapping end lying thereon is bowed upwardly in a radius. In this manner clamping of the end is prevented during the gripping process and frictionless mutual sliding is ensured.

As already mentioned in the DE-PS 31 07 990, the plates can be directed transversely of the tie axis for increasing the transverse resistance to displacement or can be arranged parallel to the tie axis for increasing the longitudinal displacement resistance of the railway. According to an advantageous further development, it is however also possible to form a combined plate from plate sections directed parallel and transversely of the tie axis and in this manner with one and the same plate to achieve both increase of the transverse displacement resistance and also increase of the longitudinal displacement resistance of a railway.

In the following for further explanation and better understanding two exemplary embodiments of the invention are described with reference to the accompanying drawings in which.

Figures 1, 2:
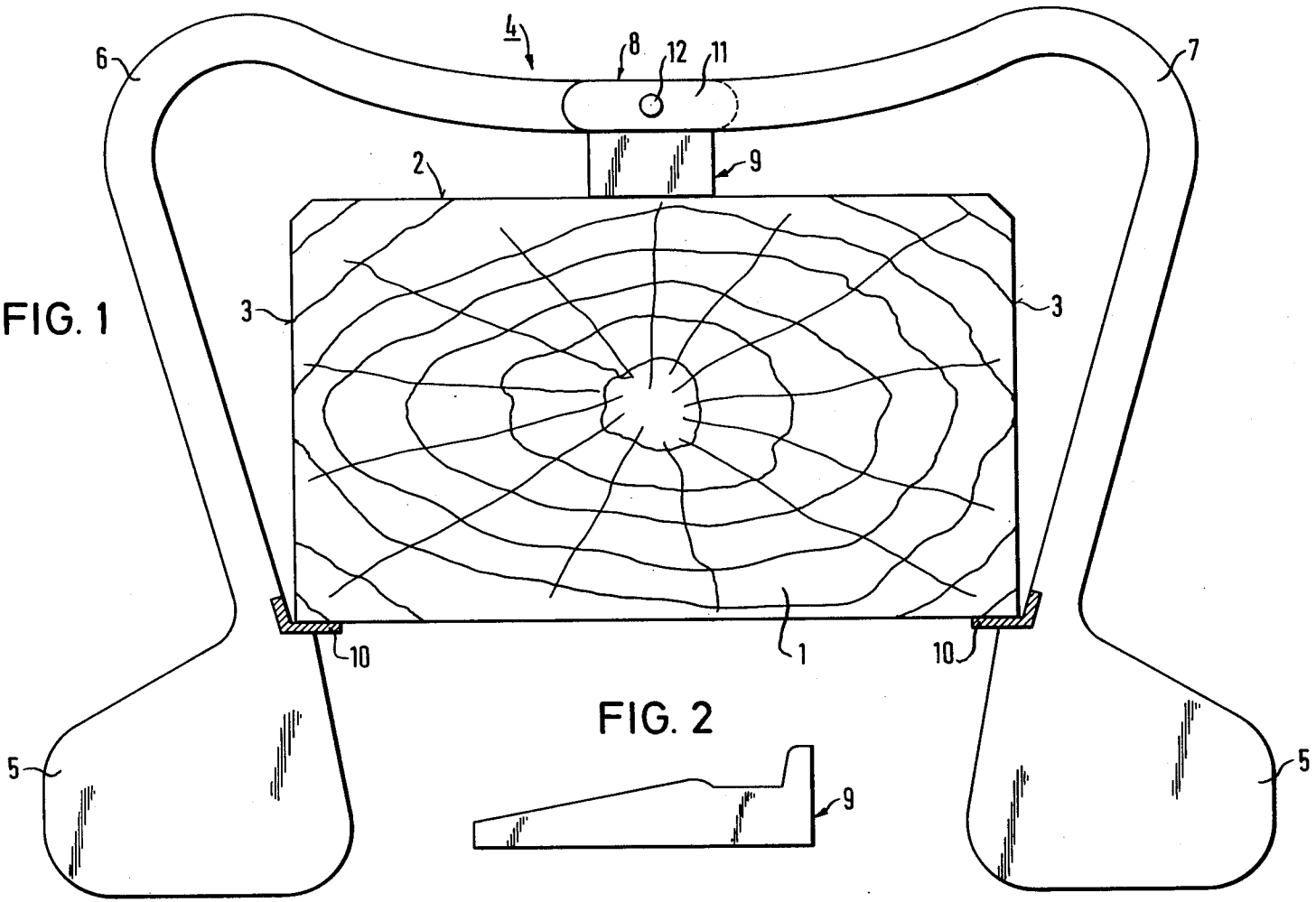
FIG. 1 shows a lateral view of a first exemplary embodiment of an anchor according to the invention.
FIG. 2 shows a front view of the tightening means utilized in the exemplary embodiment according to FIG. 1 in the form of a wedge arrangement.

The anchors represented in the Figures consist of an approximately U-shaped clamped 4 on whose ends plates 5 are secured and which embraces a tie 1 substantially transversely to its axis in the region of the tie upper surface 2 and the tie lateral surfaces 3.

In all exemplary embodiments, the U-shaped clamp 4 according to the invention is constructed of two parts, the clamp parts 6 and 7 being constructed approximately of equal size for the formation of clamping halves.

In all exemplary embodiments moreover, the connection of the clamp halves 6 and 7 is in the form of a pivot arrangement 8 and in the region of the pivot arrangement a tightening means 9 is provided for the production of a gripping force for clamping the clamp halves on the tie.

In all exemplary embodiments, the tie is gripping on both sides by the clamp 4. For this purpose in both exemplary embodiments engagement surfaces 10 are provided which in the case of the exemplary embodiment according to FIG. 1 are integrated in the clamp ends or the plates and in the case of the exemplary embodiment according to FIGS. 3 and 7 are constructed of supporting angles which are welded to the plates 5.

In all exemplary embodiments, the clamp halves 6 and 7 are bent in an approximate L-shape and are manufactured of spring steel.

In the exemplary embodiment illustrated in FIG. 1, the pivot arrangement 8 is constructed as a hinge 11 having a hinge axis 12 extending parallel to the tie axis.

Figure 3:
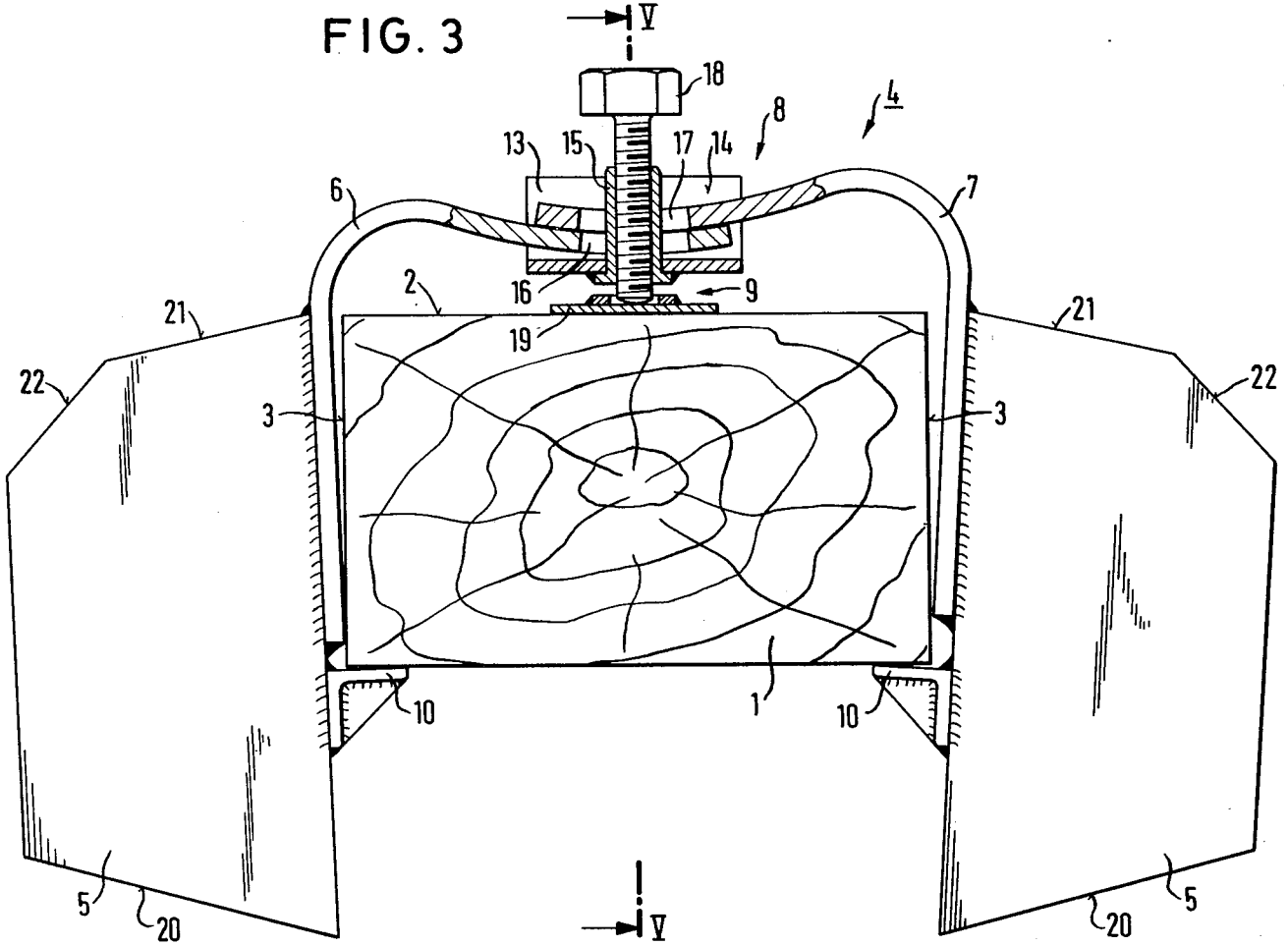
FIG. 3 shows a lateral view of a second preferred embodiment of an anchor according to the invention in the non-tightened condition.
Figure 4:
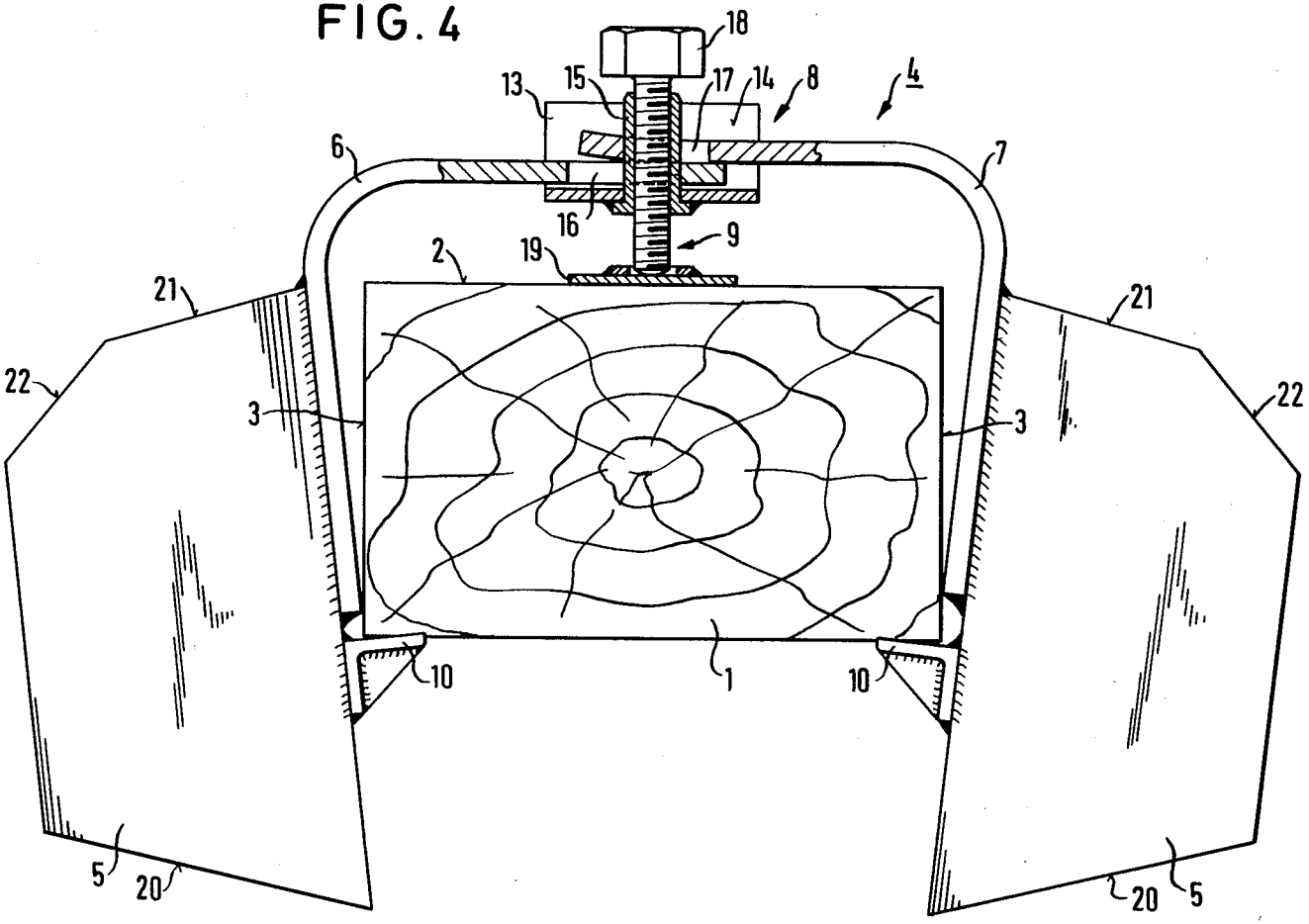
FIG. 4 shows the exemplary embodiment according to FIG. 3 in the tightened condition.

In the exemplary embodiment illustrated in FIGS. 3 and 4 on the other hand, the pivot arrangement 8 is constructed as a type of coupling arrangement with which the ends of the two clamp halves 6 and 7 are securely fastened together. As a result of the special construction, which will be described in the following, the two ends are however mutually pivotable to a limited extent about an axis extending parallel to the tie axis so that also in this exemplary embodiment the mutual coupling permits pivoting.

Figure 5:
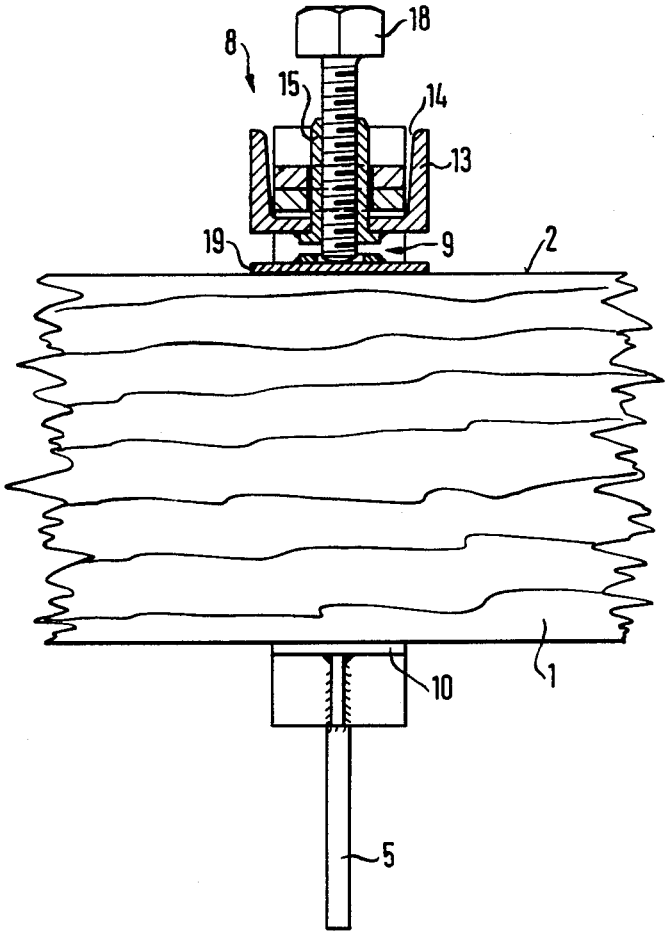
FIG. 5 shows a section along the plane IV—IV of FIG. 3.

The coupling arrangement for the ends of the two clamp halves 6 and 7 comprises in the exemplary embodiment illustrated in FIGS. 3 and 4 a coupling piece 13 which—as may be seen particularly from FIG. 5—consists of a piece of usual U profile. The coupling piece 13 has an upwardly open receiving channel 14 in which the mutually overlapping ends of the clamp halves 6 and 7 are mounted.

The coupling piece 13 is provided in its floor region with a bore in which a vertically directed sleeve 15 is secured-preferably by welding. The sleeve 15 is dimensioned in such manner that it extends slightly upwardly above the coupling piece 13.

The ends of the two clamp halves are provided with elongate holes 16 or 17 through which the sleeve 15 protrudes.

The sleeve 15 is provided in its bore with an inner thread which carries a screw bolt 18 which abuts with its free lower end on a pressure plate 19 on the upper side of the tie 1.

The form of the plates 5 is, in the exemplary embodiments illustrated in FIGS. 3 to 5, substantially trapezoidal. The lower edge 20 of each plate is in this connection constructed to be straight and is inclined in such manner that it includes an angle of about 75° with the relevant lateral surface 3 of the tie.

The upper edge of each plate 5 on the other hand is combined from two substantially straight sections. The first section 21 adjoining the respective clamp half is in this connection inclined in such manner that it includes an angle of about 80° with the relevant lateral surface 3 of the tie. The second section 22 adjoining the first section 21 is in contrast inclined in such manner that it includes an angle of about 40° with the relevant lateral surface 3.

Installation of the anchor illustrated in the drawings is carried out in the following manner:

In the exemplary embodiment illustrated in FIG. 1, the plates 5 are driven in to the ballast bed via the clamp halves 6 and 7 by means of a device either together or—after removal of the hinge bolt—sequentially.

As soon as they have assumed their predetermined position in the ballast bed and the pivot bolt has been reinserted, the wedge is driven in between the upper surface 2 of the tie and the hinge 11 as illustrated in FIG. 1. As a result, the hinge is lifted relative to the tie upper surface so that the support surfaces 10 come into fixed contact with the tie lower surfaces and dig into this slightly. The form of the clamp halves and the height of the wedge is so selected that a clamping force established previously by experiment is achieved. The bowed construction of the clamping halves 6 and 7 consisting of spring steel ensures that the predetermined tension is retained even if in operation either the wedge works slightly into the upper surface or the support surfaces work slightly into the lower surface of the tie.

As also in the case of the wedge arrangement according to DE-PS 31 07 990, the wedge has a so-called notch. This ensures that the wedge on the one hand can be inserted beneath the pivot arrangement only to a predetermined extent and on the other hand ensures that it cannot be withdrawn from its final position as a result of vibration.

In the exemplary embodiment illustrated in FIGS. 3 to 5, the plate 5 provided with the clamping half 6 is first driven in to the ballast bed at the appropriate position. For this purpose, a driving tool is applied on the first section 21 of the plate 5. As a result of the inclination of the first section 21 during the insertion process a component is always directed towards the tie so that the plate remains always in contact with the lateral surface 3 of the tie during this process. This effect is increased by the inclination of the lower surface 20 of the plate 5, so that except under very difficult ballast bed conditions it is ensured that the abutment surface 10 in the form of the retaining angle grips the lower side of the tie in its final position.

If as a result of unfavorable circumstances the plate 5 still does not achieve the necessary position in close proximity to the tie, it is only necessary to change the drive-in tool from the first section 21 to the second section 22. As a result of the inclination of the second section 22, a force can be exerted on the plate 5 which in every case ensures that the retaining angle grips the tie in the desired manner.

When the plate 5 is located in the correct position with its clamping half 6, the coupling piece 13 with the sleeve 15 is threaded in to the elongate hole 16 and thereafter the oppositely lying plate 5 with the clamping half 7 is driven into the ballast bed in the above-described manner until the elongate hole 17 of the clamping half 7 has likewise been penetrated by the sleeve 15 of the coupling piece 13.

Thereafter, the screw bolt 18 is screwed into the sleeve 15 and the pressure plate 19 is arranged on the upper side of the tie. This phase, in which the clamp is still completely untightened, is illustrated in FIG. 3.

If now the screw bolt 18 is rotated in the clockwise direction, the coupling piece 13 is lifted until the ends of the elongate holes 16 and 17 come into position on the sleeve 15 and the clamping halves are tightened. The clamping halves are then located in their tightened condition as illustrated in FIG. 4.

The upper front surface of the sleeve 15 serves in the present exemplary embodiment to limit the degree of tightening. As soon as the six-sided head of the bolt 18 lies on the upper front surface, further rotation of the bolt and thus increase of the tightening force is no longer possible.

Figure 6:
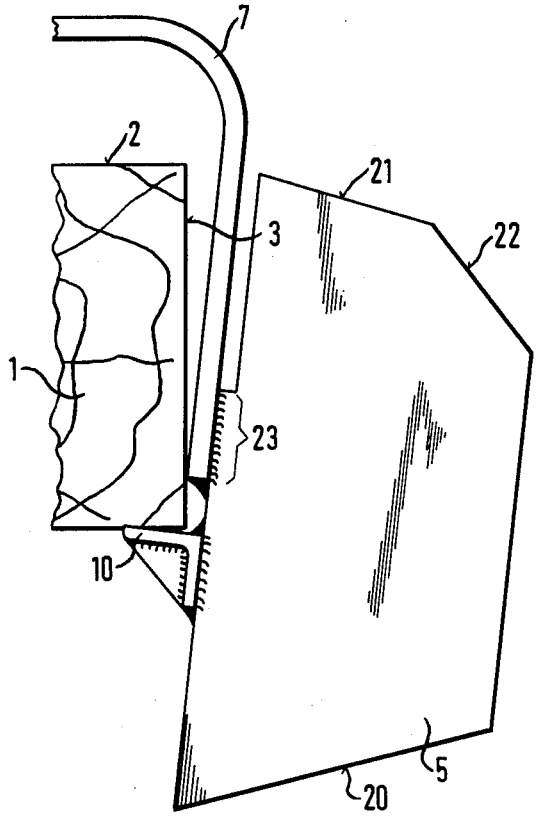
FIG. 6 shows a partially broken-away view of a third exemplary embodiment of an anchor according to the invention.

In order to utilize the spring properties of the clamping halves completely, it can be expedient to secure the plates 5 to the clamping halves only via one section 23. Such an embodiment is represented in FIG. 6.

Generally, the formation of the clamp halves and the plates can be constructed in any desired manner. According to the invention it is only necessary to form the clamp in two or more parts so that drive-in of the anchor is possible in the untightened condition. According to the invention the tightening force necessary for securing on the tie is applied only in the final position of the anchor.

What is claimed is:

1. Anchor for a railway tie embedded in ballast comprising: an approximately inverted U-shaped clamp having at least two parts to be secured to the tie to embrace this substantially transversely of the tie axis in the region of the tie upper surface and the tie lateral surfaces; each part including an abutment surface which contacts the lower surface of the rail tie, and prevents upward motion of the railway anchor with respect to the rail tie; said two parts overlapping at their upper terminal portions and connected by a pivoting arrangement comprising a tightening means which extends through said overlapping portions, said tightening means is a screw bolt which is arranged in an internal thread of a bore of a sleeve and abuts with its free lower end on a pressure plate for contact with the upper surface of the tie, said tightening means adapted to produce a tightening force on said two parts wherein their lower terminal portions are forced inwardly with respect to the lateral surface of the tie, plates on respective ends of said clamp, said plates extending outward from said clamps and lying substantially in a plane parallel to the plane of the clamp and extending beyond the lower terminal portion of said clamp for extending into the ballast for increase of the transverse and longitudinal resistance to displacement of the railway; and wherein the lower edge of each plates includes an angle with the relevant lateral surface of the tie which is smaller than 90°.

2. Anchor according to claim 1 wherein the clamp halves are curved in an L-shape and bowed in the region of the tie upper surface.

3. Anchor according to claim 1 wherein the clamp halves consist of spring steel.

4. Anchor according to claim 1 wherein the lower edge of each plate includes an angle with the relevant lateral surface of the tie which is between 60° and 80°.

5. Anchor according to claim 1 wherein the pivot arrangement is constructed as a coupling arrangement with which the ends of the two clamp halves are secured and coupled for limited relative pivoting movement about an axis approximately perpendicular to the plane of the clamp.

* * * * *